US009896832B2

(12) United States Patent
Graf

(10) Patent No.: US 9,896,832 B2
(45) Date of Patent: Feb. 20, 2018

(54) PERCOLATION BLOCK ELEMENT, PERCOLATION BLOCK, AND TRANSPORT UNIT

(71) Applicant: OTTO GRAF GMBH KUNSTSTOFFERZEUGNISSE, Teningen (DE)

(72) Inventor: Otto P. Graf, Teningen (DE)

(73) Assignee: Otta Graf GMBH Kunststofferzeugnisse, Teningen (DE)

( * ) Notice: Subject to any disclaimer, the term of this patent is extended or adjusted under 35 U.S.C. 154(b) by 0 days.

(21) Appl. No.: 15/032,759

(22) PCT Filed: Oct. 21, 2014

(86) PCT No.: PCT/EP2014/072546
§ 371 (c)(1),
(2) Date: Apr. 28, 2016

(87) PCT Pub. No.: WO2016/015786
PCT Pub. Date: Feb. 4, 2016

(65) Prior Publication Data

US 2016/0265209 A1 Sep. 15, 2016

(30) Foreign Application Priority Data

Aug. 1, 2014 (EP) ..... 14179427

(51) Int. Cl.
*E03F 1/00* (2006.01)

(52) U.S. Cl.
CPC ..... *E03F 1/005* (2013.01)

(58) Field of Classification Search
CPC ..... B65D 21/04; E03F 1/002; E03F 1/005; E03B 3/03
See application file for complete search history.

(56) References Cited

U.S. PATENT DOCUMENTS

| | | | | |
|---|---|---|---|---|
| 2009/0250369 | A1 | 10/2009 | Guibert et al. | 206/507 |
| 2012/0141203 | A1* | 6/2012 | Gooden | A01G 13/0237 404/41 |
| 2014/0291221 | A1 | 10/2014 | Adams et al. | 210/170.03 |

FOREIGN PATENT DOCUMENTS

| | | |
|---|---|---|
| AU | 2009101081 | 11/2012 |
| DE | 102011086016 | 5/2013 |
| EP | 2107172 | 10/2009 |

(Continued)

OTHER PUBLICATIONS

Search report dated Jan. 28, 2015 in corresponding EP Application No. EP 14 17 9427.

*Primary Examiner* — Sean D Andrish
(74) *Attorney, Agent, or Firm* — Fattibene and Fattibene; Paul A. Fattibene

(57) ABSTRACT

A percolation block element having a base wall and hollow columns. With two identical percolation block elements that are aligned in the same direction, a stack of the two identical percolation block elements can be formed. The percolation block element has an axial symmetry of 180° or less. With two identical percolation block elements arranged rotated by 90° relative to one another about a rotational axis, the column tips of the first percolation block element can be introduced into the column tip receptacles of the second percolation block element, and an operating distance can be formed between a first base wall and a second base wall.

18 Claims, 13 Drawing Sheets

(56) References Cited

FOREIGN PATENT DOCUMENTS

| | | | |
|---|---|---|---|
| JP | 2008031774 | | 2/2008 |
| JP | 2012062686 | | 3/2012 |
| JP | 5294439 | * | 9/2013 |
| WO | WO 2013136630 | | 9/2013 |
| WO | WO 2013151020 | | 10/2013 |

* cited by examiner

PERCOLATION BLOCK ELEMENT, PERCOLATION BLOCK, AND TRANSPORT UNIT

FIELD OF THE INVENTION

The invention relates to a percolation block element, a percolation block.

PRIOR ART

For underground intermediate storage of surface water, such as rain water from roofs and/or sealed floor surfaces, a plurality of water retention tanks or drainage trench units can be arranged as a basin. The basin is at least in part provided with passages for water, so that the stored surface water can be discharged gradually to the surrounding ground soil.

EP 2 107 172 A1 discloses water retention tanks with a rectangular base area, where two identical water retention tanks that are aligned in the same direction can be stacked inside one another. For the construction of a water retention basin, the two identical water retention tanks are rotated by 180° relative to one another about the central axis and arranged one above the other. The feet of the one water retention tank there engage with receptacles of the other water retention tank. The arrangement of the feet and the receptacles receiving them results in unbalanced application of load for two superposed water retention tanks. At the edge of the water retention tank, upper and lower support levels are alternately given which with superposed water retention tanks engage with one another.

DE 10 2011 086 016 A1 discloses drainage trench sub-units, where two identical drainage trench sub-units that are aligned in the same direction can be stacked inside one another. For the construction of a drainage trench unit, two identical drainage trench sub-units are oriented inverse to each other such that the tip ends of the columns face each other and engage in recesses which are encompassed by an intermediate plate on their bottom as well as on their upper side.

OBJECT OF THE INVENTION

The invention is based on the object of providing percolation block elements that in addition to advantageous stackability for transportation further provide for a stable and load-bearing arrangement for underground installation and operation.

SOLUTION

The object is satisfied by the percolation block element according to one embodiment, the percolation block according to another embodiment and the transport unit according to yet another embodiment. Additional preferred embodiments are disclosed.

The percolation block element comprises a base wall having a base area to which a plurality of hollow columns is connected. The columns are designed and arranged such that, with two identical percolation block elements that are aligned in the same direction, the first columns of the first percolation block element can be introduced into the second columns of the second percolation block element and a stack of two identical percolation block elements that are aligned in the same direction can be formed. The base wall comprises column tip receptacles which are configured to receive the column tips. The percolation block element has an axial symmetry of 180° or less when rotated about an axis of rotational symmetry which extends perpendicular to the base area of the base wall. The column tip receptacles and the columns are further configured and arranged such that, with two identical percolation block elements arranged rotated by 90° or less relative to each other about a rotational axis that is perpendicular to the base area of the base wall, the column tips of the first percolation block element can be introduced into the column tip receptacles of the second percolation block element such and an operating distance can be formed between a first underside of a first base wall and an upper side of a second base wall.

The edge length of the base wall can be 800±200 mm and its thickness 40±20 mm.

A stack of two or more percolation block elements enables a space-saving arrangement of percolation block elements by introduction of the columns of one percolation block element into the columns of a percolation block element arranged therebeneath. Such an arrangement of percolation block elements being stacked inside one another is useful, for example, during transportation by truck from a production plant and/or a warehouse to a construction site because space efficiency on the truck can thereby be optimized.

A distance can exist between a first underside of the first base wall and an upper side of the second base wall when two percolation block elements are stacked inside one another, i.e., when the first columns of the first percolation block element are introduced into the second column of the second percolation block element. This so-called stacking distance can amount to 20±20 mm, i.e. the stacking distance can also be 0 mm, so that an upper side and an underside of two percolation block elements come to rest one on the other.

The term operating distance is the distance between the first underside of the first base wall and the upper side of the second base wall when, with two identical percolation block elements arranged rotated by 90° or less relative to one another about the rotational axis, the column tips of the first percolation block element are introduced into the column tip receptacles of the second percolation block element. This arrangement corresponds to that for operation as an underground water basin. The operating distance can be 354±20 mm.

The column tips are arranged at the end of the columns which faces away from the base wall. The column tips preferably have a smaller cross-section than the columns and are received or clipped in a positive-fit manner by the column tip receptacles of the base walls. An arrangement of percolation block elements for operation thereby enables a reliable and stable connection of two percolation block elements without further aids. A column tip can have a length of 20±10 mm.

The column tip receptacles in the base wall are advantageously formed end-to-end such that water can pass through the column tip receptacles, through the hollow columns and through openings in the columns and/or the column tips.

If the base area of the percolation block element is formed to be square, then the percolation block element can have an axial symmetry of 180° when rotated about the axis of rotational symmetry. An operating distance between two percolation block elements can be formed when two identical percolation block elements are arranged rotated by 90° relative to each other about a rotational axis that is perpendicular to the base area of the base wall. In the case of percolation block elements having a square base, the axis of rotational symmetry and the rotational axis are identical. The axis of rotational symmetry or the rotational axis, respectively, passes through the intersection of the two 45°-diagonals of the base area of the base wall and extends perpendicular to the base area.

If the base area of the percolation block element is formed to be rectangular, then the percolation block element can have an axial symmetry of 180° when rotated about the axis of rotational symmetry, where the axis of rotational symmetry extends perpendicular to the base area of the base wall and can pass through the intersection of the two diagonals of the base area. The column tip receptacles and the columns of the percolation block element having a rectangular base area can be configured and arranged such that, with two identical percolation block elements arranged rotated by 90° relative to one another about a rotational axis that is perpendicular to the base area of the base wall, the column tips of the first percolation block element, i.e. of the upper percolation block element, can be introduced into the column tip receptacles of the second percolation block element, i.e. of the lower percolation block element, and an operating distance can be formed between a first underside of the first base wall and a upper side of the second base wall. Depending on the arrangement of the columns and the column tip receptacles, the axis of rotational symmetry and the rotational axis can be the same or different.

If the base area of the percolation block element is formed to be hexagonal, then the percolation block element can have an axial symmetry of 180°, 120°, or 60° when rotated about the axis of rotational symmetry. Depending on the arrangement of columns and column tip receptacles, an operating distance can be obtained between two percolation block elements having a hexagonal base area when two identical percolation block elements are rotated by 60° relative to one another about a rotational axis that is perpendicular to the base area of the base wall. With a percolation block element having a hexagonal base surface, the axis of rotational symmetry and the rotational axis are generally the same.

If the base area of the percolation block element is formed to be octagonal, then the percolation block element can have an axial symmetry of 180°, 135°, 90° or 45° when rotated about the axis of rotational symmetry. Depending on the arrangement of columns and column tip receptacles, an operating distance can be obtained between two percolation block elements having an octagonal base area when two identical percolation block elements are rotated by 90° or 45° relative to one another about a rotational axis that is perpendicular to the base area of the base wall. With a percolation block element having an octagonal base surface, the axis of rotational symmetry and the rotational axis are generally the same.

The columns can be formed to be substantially conical. This refers substantially to the outer shape of the columns. Since the columns are hollow, the inner shape can correspond to the outer shape while taking into account the wall thickness (for example 3±1 mm). However, it can also be provided that the inner shape and the outer shape of the column do not correspond to each other. A cone or an approximate cone can end in the region of the column tips—i.e. a truncated cone or a truncated approximate cone, so that the column tips project from the truncated cone. When the cross-section of the column tips is smaller than the cross-section of the truncated cone or the truncated approximate cone, respectively, a step is formed. The conical or approximately conical shape provides for good stability and allows for stacking the percolation block elements inside one another.

It can be provided that the columns have a round, an oval or a polygonal cross-section. It can also be provided that the columns have a cross-section with a wavy edge.

The columns can each comprise at least one opening. The at least one opening enables the passage of water through this at least one opening and through the hollow columns, at the one end of which the column tips are located. Water can thereby pass through the at least one opening into a percolation block element disposed therebeneath and/or the ground soil. The at least one opening can be disposed on the side surface of a column, in the step, and/or in the column tip.

The base wall can comprise a rib structure. The rib structure enables the passage of water while also providing the necessary stability of the percolation block element when it is buried in the ground.

The column tips can have a smaller cross-section than the columns, so that a step is respectively formed at an underside of the column. The column tip receptacles of the base wall and/or the receptacles of the base plate and/or the recesses of the transport plate can respectively be formed converse to the shape of the column tips and the steps, so that with identical percolation block elements each arranged rotated by 90° or less relative to one another about the rotational axis, the column tips of a percolation block element can engage in a positive-fit manner with the column tip receptacles or the recesses of the base plate or the recesses of the transport plate. The shape of the column tips can also effect centering in the column tip receptacle.

The inner sides of the columns can each comprise a projection which is configured and arranged such that, with two identical percolation block elements that are aligned in the same direction, the steps can be introduced in a positive-fit manner into the projections. It can be avoided when transporting several percolation block elements stacked inside one another that the individual percolation block elements move relative to one another and that damage and/or wear occurs during transport. In addition, any wedging of percolation block elements within each other can be avoided.

The percolation block element can be formed from at least one plastic molding. Recycled plastic can be used. The percolation block elements therefore combine the advantages of comparably low weight and a high stability.

The columns can be integrally connected to the base wall. This has the advantage that the base wall and the columns can be produced in one casting process, and that subsequent assembly of the individual columns on the base wall is not necessary.

It can also be provided that the columns are detachably connected to the base wall. A positive-fit connection is preferably provided respectively between the columns and the base wall, where also a force-fit connection can additionally be provided.

It can in another embodiment be provided that some of the columns are integrally connected to the base wall and the other columns are detachably connected to the base wall.

The base area of the base wall can be rectangular, hexagonal or octagonal. It can also be provided that a base area of a base wall is formed by a plurality of identical rectangular, hexagonal or octagonal base areas.

The base area of the base wall can be square.

With a square base area, the columns and the column tip receptacles can be arranged such that they are each arranged in mirror symmetry with respect to both center lines of the base wall and are each not in mirror symmetry with respect to both 45°-diagonals of the base wall. With identical percolation block elements each arranged rotated by 90° or less relative to one another about the rotational axis, this enables a symmetric application of load so that it is possible to arrange a plurality of percolation block elements above one another in the ground, without the stability of this arrangement being endangered by the forces acting upon them.

When mirroring at the two 45°-diagonals of the base wall, a column tip receptacle can preferably come to rest at the position of a column and a column at the position of a column tip receptacle, respectively.

In one embodiment with a square base area, an odd number or an even number of columns can be arranged at opposite edges of the base wall in mirror symmetry to the center lines, where the respective even number or the respective odd number of column tip receptacles is located between and adjacent to the columns. In a central region of the base wall, three or two columns, respectively, are further located oppositely disposed each in mirror symmetry to the center lines, where two or three column tip receptacles are located between and adjacent to the columns. Disposed adjacent to the rotational axis or the axis of rotational symmetry, respectively, are two columns between which two column tip receptacles are located. However, more or fewer columns or column tip receptacles can also be present as long as it is preferably satisfied that the columns and column tip receptacles are each arranged in mirror symmetry with respect to both center lines of the base wall and each arranged not in mirror symmetry with respect to both 45°-diagonals of the base wall and additionally when mirroring at the two 45°-diagonals of the base wall, a column tip receptacle can come to rest at the position of a column and a column at the position of a column tip receptacle, respectively.

If, with two identical percolation block elements with a square base arranged rotated by 90° relative to one another about a rotational axis, the column tips of the first or the upper percolation block element, respectively, are introduced into the column tip receptacles of the second or lower percolation block element, respectively, and an operating distance is formed between the underside of the base wall of the upper percolation block element and the upper side of the base wall of the lower percolation block element, then this results in a symmetric application of load. In particular the force exerted by a column of the upper percolation block element is evenly transferred to two columns of the lower percolation block element because the column tip receptacle for the column of the upper percolation block element is disposed on the surface of the base wall of the lower percolation block element in the region between two columns of the lower percolation block element.

When viewing the line profile of the wall of a first column of the upper base wall along a vertical plane, starting out from a first location, at which the first column and a first column tip receptacle of the upper base wall directly adjoin, to the upper side of the lower base wall, where the first column tip of the first column is introduced into a second column tip receptacle of the lower base wall, and from there transitioning to the line profile of the wall of a second column of the lower base wall, starting out from a second location, at which the second column and the second column tip receptacle of the upper base wall directly adjoin, it can be seen that this line profile of the wall of the first column and the wall of the second column merge into each other. The line profile can be regarded as being approximately in flush alignment.

It can in another embodiment also be provided that a base area of a base wall is formed by a plurality of identical square base areas.

It can for a percolation block element comprising a base wall with a rectangular base area to which a plurality of hollow columns are connected be provided in particular that two or more identical percolation block elements each having a square base are arranged in the same orientation adjacent to each other. Arranged adjacent can there mean that a) the two or more identical percolation block elements each having a square base for producing the base wall with the rectangular base area are manufactured from one plastic molding, or b) the two or more identical percolation block elements each having a square base area for producing the base wall with the rectangular base area are each manufactured from one plastic molding and then joined together by connection devices.

In the case of two identical percolation block elements each having a square base which are arranged being aligned in the same direction adjacent to each other, the columns of the percolation block element with a base wall having a rectangular base area are configured and arranged such that with two identical percolation block elements that are aligned in the same direction, the first columns of the first percolation block element can be introduced into the second columns of the second percolation block element and a stack of two identical percolation block elements that are aligned in the same direction can be formed. The base wall comprises column tip receptacles which are configured to receive the column tips.

The percolation block element has an axial symmetry of 180° when rotated about an axis of rotational symmetry, where the axis of rotational symmetry there passes through the intersection of the two diagonals of the rectangular base area and extends perpendicular to the rectangular base area.

The column tip receptacles and the columns are further configured and arranged such that, with two identical percolation block elements arranged rotated by 90° relative to one another about a rotational axis that is perpendicular to the base area of the base wall, some of the column tips of the first percolation block element can be introduced into some of the column tip receptacles of the second percolation block element and an operating distance can be formed between a first underside of a first base wall and an upper side of a second base wall. The perpendicular rotational axis passes through the intersection of the two 45°-diagonals of the square base area and extends perpendicular to the square base area.

A percolation block comprises at least one percolation block element as described above or farther below and a base plate with receptacles that are designed to receive column tips. The base plate provides an end of the percolation block element toward the bottom. The receptacles can receive the column tips of the percolation block element preferably in a positive-fit manner, so that a reliable and stable connection of a percolation block element and a base plate is possible without additional aids.

If the columns are detachably connected to the base wall, then the base wall and the base plate can be formed the same.

The at least one percolation block element can comprise at least one side wall, where the at least one side wall is preferably detachably connected to the at least one percolation block element. A sidewall provides an end of the percolation block element toward one side, provided that no further percolation block elements are arranged there. The side wall can have a rib structure, so that the passage of water is enabled.

The base plate and/or the at least one side wall can each be formed from at least one plastic molding. Recycled plastic can be used for this.

A transport unit comprises a plurality of identical percolation block elements that are aligned in the same direction as described above and farther below, in which the columns are introduced into one another, and a transport plate or a base plate on which the identical percolation block elements that are aligned in the same direction are arranged, where the transport plate or the base plate at its underside preferably comprises feet. The feet enable, for example, that the fork of a forklift can be introduced beneath the transport plate or the base plate. The feet can be integrally connected to the underside or they can be attached by way of a positive-fit and/or force-fit connection to the underside. The feet are preferably detachably connected to the underside of the transport plate or the underside of the base plate.

On the upper side, the transport plate or the base plate comprises recesses into which the column tips of a percolation block element can be introduced.

The transport plate or the base plate can be formed from at least one plastic molding. Recycled plastic can be used for this.

BRIEF DESCRIPTION OF THE FIGURES

Further advantages and embodiments arise from the accompanying drawings, where in the drawings.

DETAILED DESCRIPTION OF THE FIGURES

Figure 1:
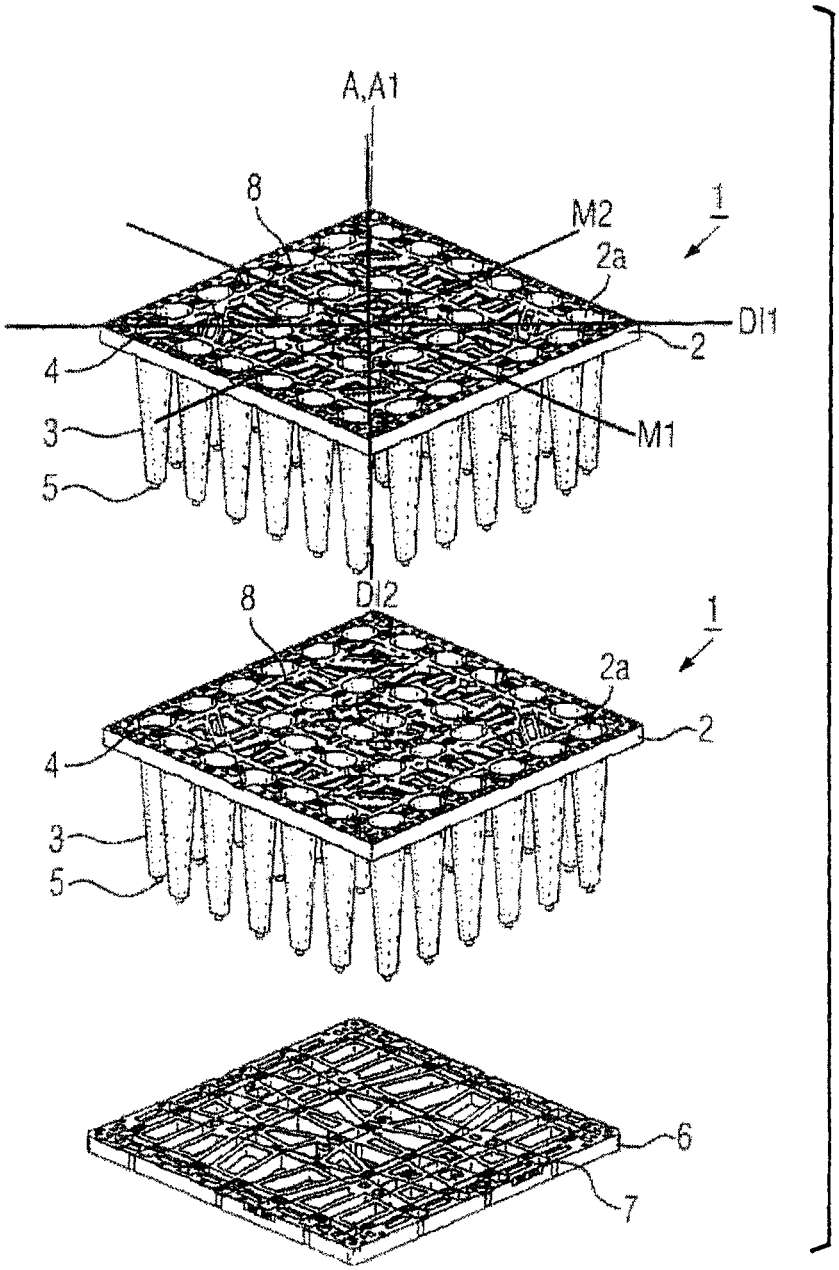
FIG. 1 shows an oblique view of two percolation block elements and a base plate.

FIG. 1 shows two percolation block elements 1, each comprising a base wall 2 having a square base area, with which a plurality of—presently a number of 34—hollow columns 3 are connected Columns 3 are formed conically with an oval cross-section and each comprise a column tip 5 at the end facing away from base wall 2. A percolation block element 1 has an axial symmetry of 180° when rotated about the axis of rotational symmetry A1 of the base area, wherein the axis of rotational symmetry A1 extends perpendicular to the base area of base wall 2 and passes through the intersection of the two 45°-diagonals DI1, DI2 of base wall 2. Columns 3 are arranged such that they are not disposed in mirror symmetry with respect to both center lines M1, M2 of base wall 2 and are in mirror symmetry with respect to both 45°-diagonals DI1, DI2 of base wall 2. When mirroring at the two 45°-diagonals DI1, DI2 of base wall 2, a column tip receptacle 4 comes to rest at the position of a column 3 and a column 3 at the position of a column tip receptacle 4, respectively, (see also FIG. 2). This results—as explained in detail in the context of FIGS. 5 and 6—in a symmetrical application of load to two or more superimposed percolation block elements each rotated by 90° about rotational axis A, which presently corresponds to the axis of rotational symmetry A1, of the base area.

In FIG. 1, upper percolation block element 1 is rotated relative to the lower percolation block element by 90° about the rotational axis A of the base area. Base wall 2 comprises column tip receptacles 4 which are configured to receive column tips 5 of columns 3.

Base plate 6 also comprises receptacles 7 which are adapted to receive column tips 5 of columns 3. Base plate 6 represents an end of lower percolation block element 1 toward the bottom, where receptacles 7 receive column tips 5 of lower percolation block element 1 preferably in a positive-fit manner, so that a reliable and stable connection of lower percolation block element 1 and base plate 6 is possible without additional aids. Base plate 6 can be formed substantially like base wall 2.

Figure 2:
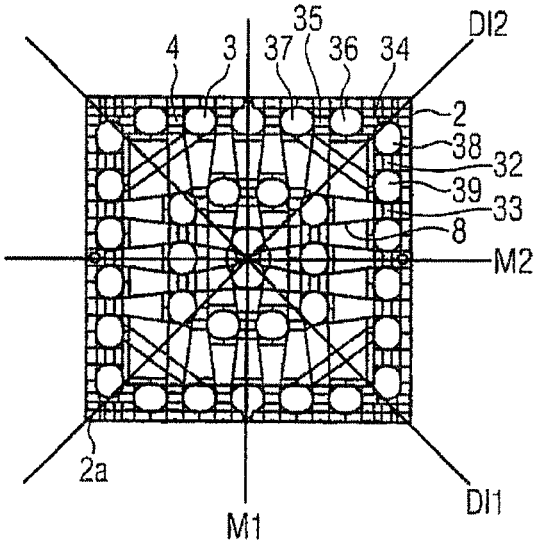
FIG. 2 shows a plan view of the upper side of a percolation block element.

FIG. 2 shows a plan view of upper side 2*a* of a percolation block element 1. Clearly visible is the rib structure 8 of base wall 2 which allows the passage of water. Column tip receptacles 4 are in structure 8 of the base wall provided between columns 3.

Five and six columns 3, respectively, are each arranged at oppositely disposed edges of base wall 2 in mirror-symmetry to the one center line M2 or to the other center line M1, respectively, where six and five column tip receptacles 4, respectively, are each located between and adjacent to columns 3. Three and two columns 3, respectively, are further located in a central region of base wall 2 in mirror symmetry to the other center line M1 or to the one center line M2, respectively, where two and three column tip receptacles 4, respectively, are located between and adjacent to these columns 3. A column 3 is respectively arranged adjacent to the intersection of the two center lines M1, M2 in mirror symmetry to the one center line M2, where two column tip receptacles 4 are located on the one center line M2 between the two columns 3.

It is by way of example shown in FIG. 2 for four columns 36, 37, 38, 39 and four column tip receptacles 32, 33, 34, 35 that, when mirroring at the one 45°-diagonal DI2 of base wall 2, a column tip receptacle 32, 33 is located at the position of a column 36, 37 and a column 38, 39 at the position of a column tip receptacle 34, 35, respectively. The same applies to mirroring at the other 45°-diagonal DI1 of base wall 2.

Figure 3:
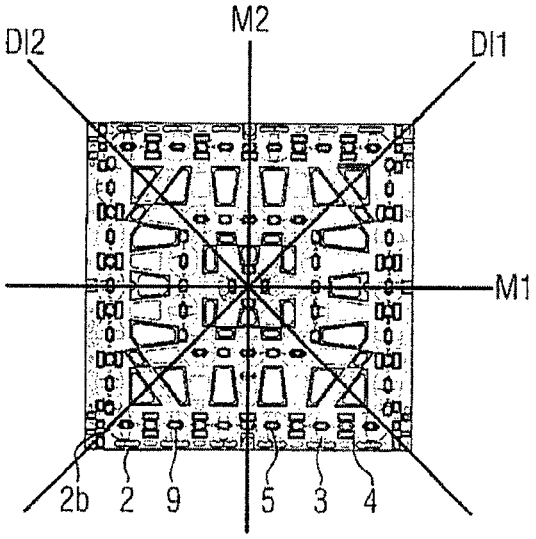
FIG. 3 shows a plan view of the underside of a percolation block element.

FIG. 3 shows a plan view of underside 2*b* of percolation block element 1, where hollow columns 3 with the oval cross-section extend perpendicular away from underside 2*b* of base wall 2. Column tips 5 have an end-to-end opening 9 which allows the passage of water through this opening 9 and hollow columns 3.

FIGS. 2 and 3 illustrate that column tip receptacles 4 and columns 3 are formed and arranged such that, with two identical percolation block elements 1 arranged rotated by 90° relative to one another about rotational axis A, column tips 5 of upper percolation block element 1 can be introduced into column tip receptacles 4 of lower percolation block element 1 and that with two identical percolation block elements 1 that are aligned in the same direction, columns 3 of upper percolation block element 1 can be introduced into columns 3 of lower percolation block element 1.

Figure 4:
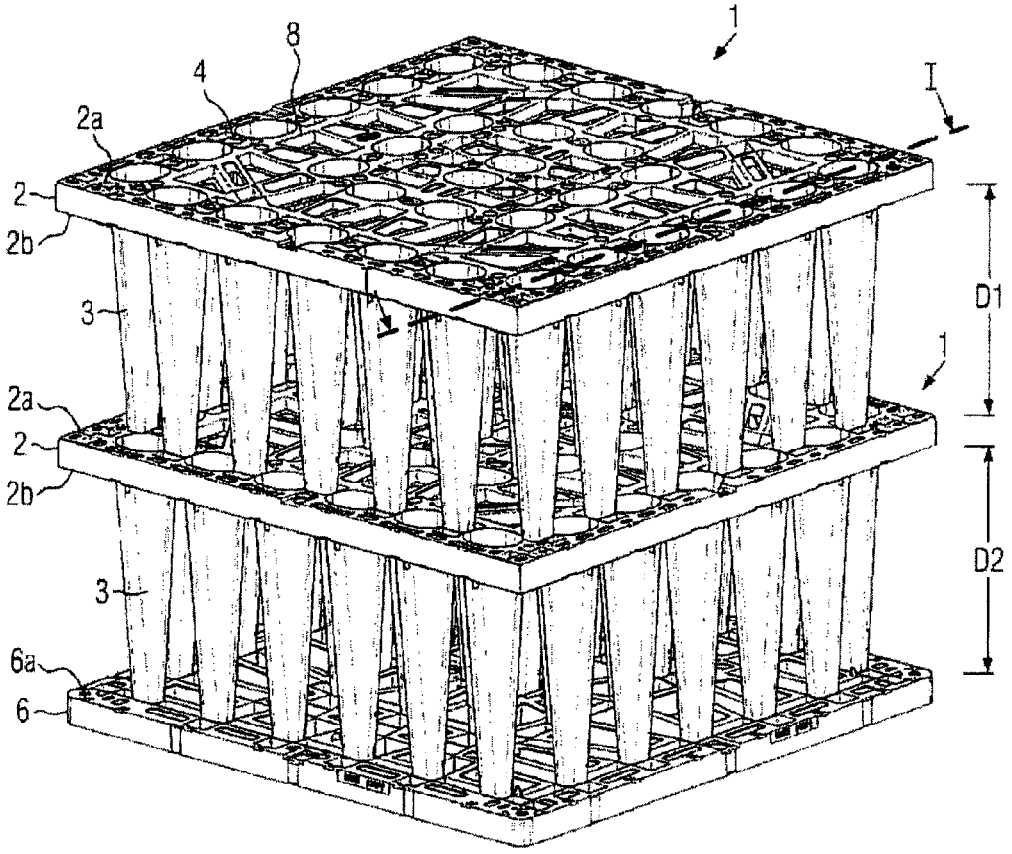
FIG. 4 shows the assembled elements from FIG. 1.

FIG. 4 shows the assembled elements of FIG. 1, i.e. the two percolation block elements 1 and base plate 6. An operating distance D1 arises between underside 2*b* of upper base wall 2 and upper side 2*a* of lower base wall 2. A distance D2 arises between underside 2*b* of lower base wall 2 and upper side 6*a* of base plate 6, where D1 is equal to D2.

Figure 5:
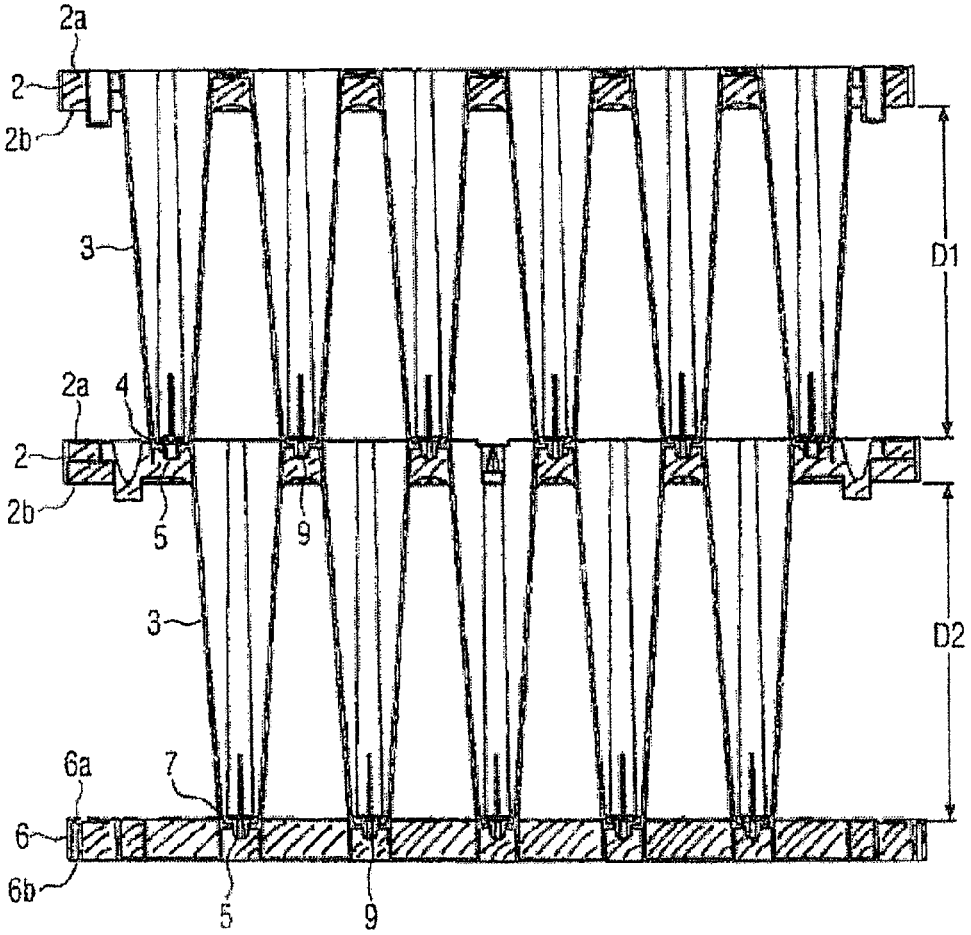
FIG. 5 shows a sectional view of FIG. 4 along line I-I.

FIG. 5 shows a sectional view of FIG. 4 along line I-I. Column tips 5 with openings 9 of upper percolation block element 1 engage with column tip receptacles 4 of lower percolation block element 1, and column tips 5 with openings 9 of lower percolation block element 1 engage with receptacles 7 of base plate 6. As already mentioned in FIG. 4, an operation distance D1 arises between underside 2*b* of upper base wall 2 and upper side 2*a* of lower base wall 2, and a distance D2 between underside 2*b* of lower base wall 2 and upper side 6*a* of base plate 6, where D1 is equal to D2. The base plate 6 comprises an underside 6*b*.

Columns 3 are arranged, as already mentioned, such that they are disposed in mirror symmetry with respect to both center lines M1, M2 of base wall 2 and are not disposed in mirror symmetry with respect to both 45°-diagonals DI1, DI2 of base wall 2, where, when mirroring at the two 45°-diagonals DI1, DI2 of base wall 2, a column tip receptacle 4 comes to rest at the position of a column 3 and a column 3 at the position of a column tip receptacle 4, respectively. With identical percolation block elements 1 each rotated by 90° relative to one another about a rotational axis a, this enables a symmetric application of load. The sectional view shown in FIG. 5 and the enlarged detail of FIG. 6 show that the load is transferred from one column 3 of upper percolation block element 1 evenly to two columns 3 of percolation block element 1 disposed therebeneath because column tip receptacle 5 for upper column 3 is arranged on surface 2*a* of base wall 2 of percolation block element 1 disposed therebeneath in the region between two columns 3 of percolation block element 1 disposed therebeneath.

Figure 6:
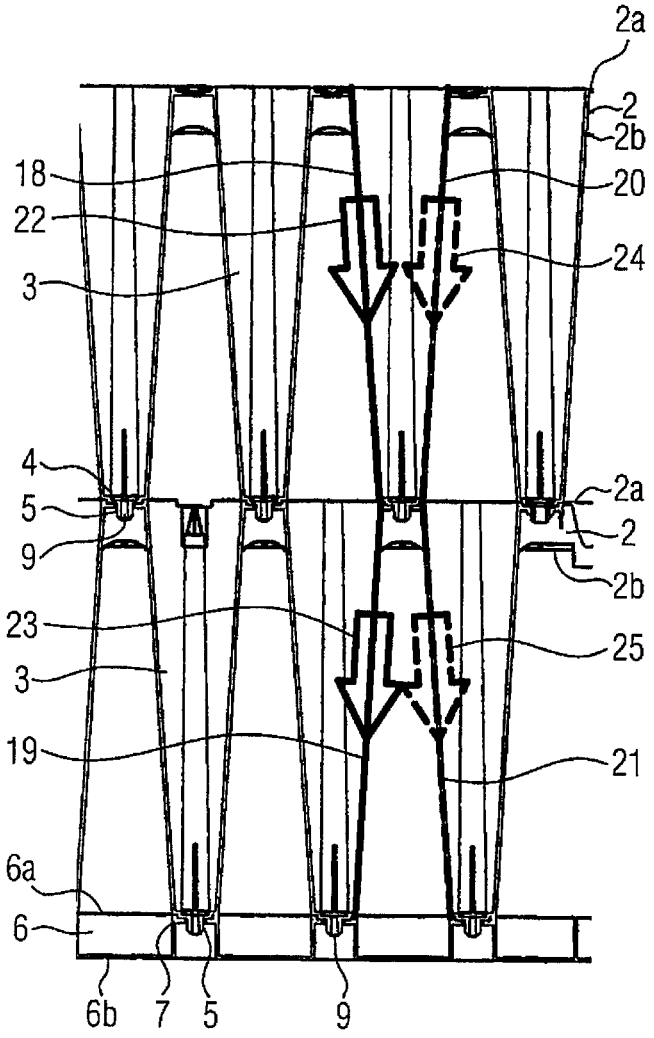
FIG. 6 shows the line profile of the wall of columns and a distribution of force.

FIG. 6 shows the line profile of wall 18 (continuous line) of a first column 3 of upper base wall 2 along a vertical plane, starting out from a first location, at which first column 3 and first column tip receptacle 4 of upper base wall 2 directly adjoin, to upper side 2*a* of lower base wall 2, where first column tip 5 of first column 3 is introduced into a second column tip receptacle 4 of lower base wall 2, and from there transitioning to the line profile of wall 19 (continuous line) of a second column 3 of lower base wall 2, starting out from a second location, at which second column 3 and second column tip receptacle 4 of upper base wall 2 directly adjoin, it can be seen that this line profile of wall 18 of first column 3 and wall 19 of second column 3 merge into each other.

Accordingly, the line profile of wall 20 (dashed line) of first column 3 and wall 21 (dashed line) of second column 3 merge into each other. The line profile of wall 20 of first column 3 of upper base wall 2 is shown along a vertical plane, starting out from a first location, at which first column 3 and a third column tip receptacle 4 of upper base wall 2 directly adjoin, to upper side 2*a* of lower base wall 2, where first column tip 5 of first column 3 is introduced into second column tip receptacle 4 of lower base wall 2, and from there transitioning to the line profile of wall 21 of a second column 3 of lower base wall 2, starting out from a third location at which third column 3 and second column tip receptacle 4 of upper base wall 2 directly adjoin.

The forces acting from first column 3 of upper base wall 2 onto columns 3 of lower base wall 2 are illustrated by two arrows 22, 24. The one part of force 22 therefore transfers to second column 3 of lower base wall 2, illustrated by arrow 23, and the other part of force 24 transfers to third column 3 of lower base wall 2, illustrated by arrow 25.

Figure 7:
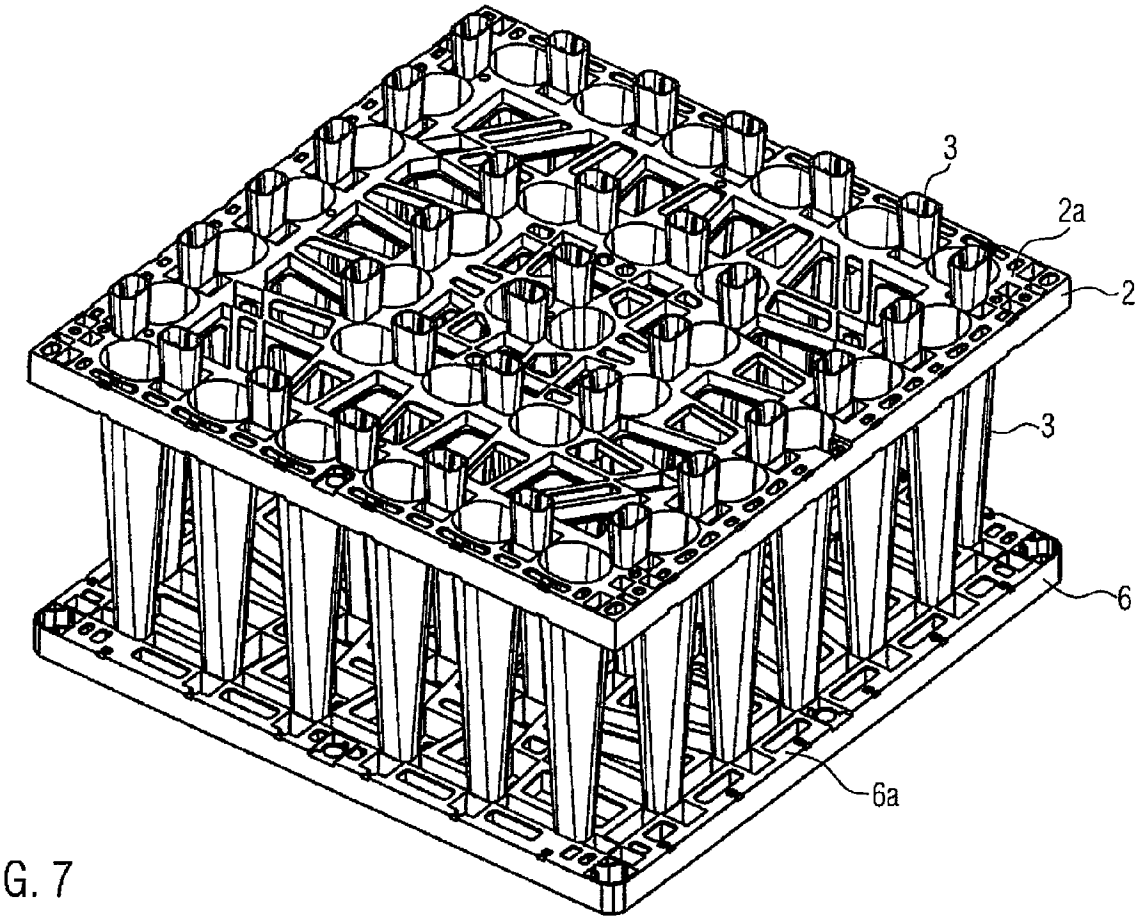
FIG. 7 shows an oblique view of the base plate of the lower percolation block element and positions of the columns of the upper percolation block element.

FIG. 7 shows an oblique view of base plate 6 of lower percolation block element 1 and upper percolation block element 1 truncated in the region of columns 3 in order to be able to display more clearly the positions of columns 3 of upper percolation block elements 1 relative to lower percolation block element 1.

Figure 8:
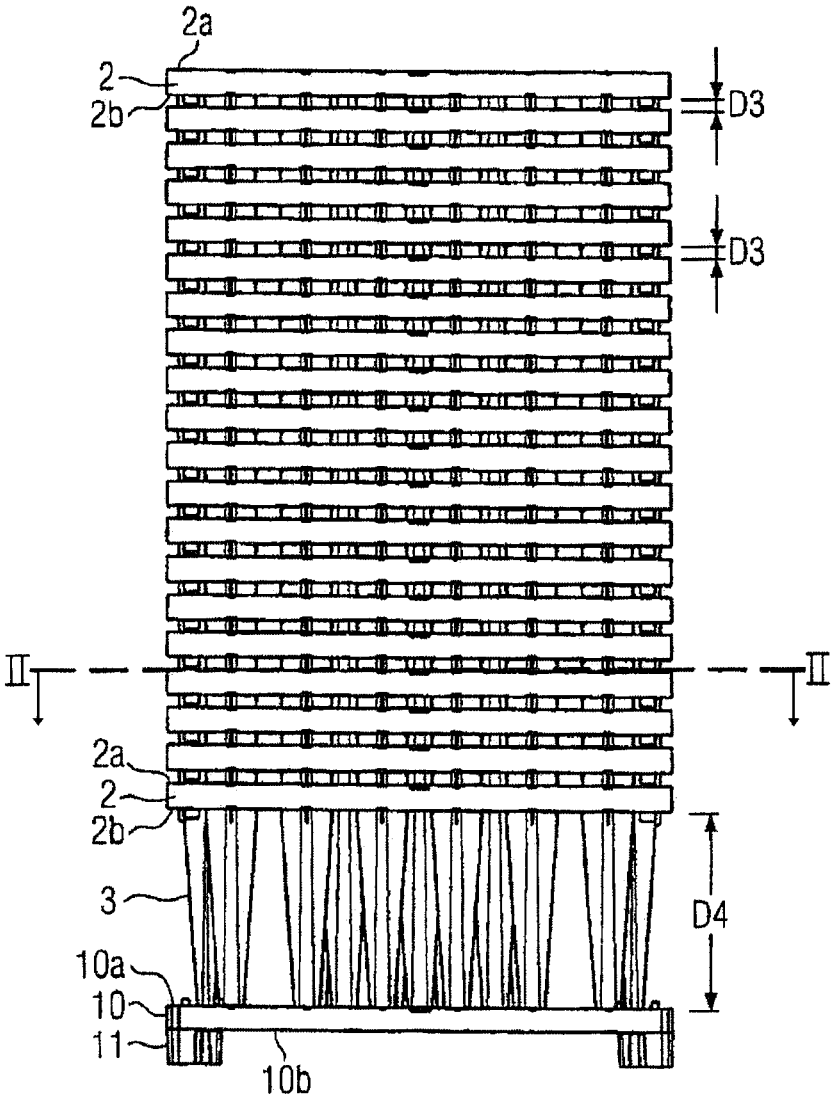
FIG. 8 shows a side view of stacked percolation block elements.

FIG. 8 shows a side view of twenty percolation block elements 1 stacked inside one another. This stacking possibility arises from the fact that columns 3 of percolation block elements 1 are configured and arranged such that, with identical percolation block elements 1 that are aligned in the same direction, columns 3 of a percolation block element 1 disposed above can be introduced into columns 3 of a percolation block element 1 disposed therebeneath. A stacking distance D3 arises in the illustration between an underside 2*b* of a base wall 2 disposed above and an upper side 2*a* of a base wall 2 disposed therebeneath.

Percolation block elements 1 stacked inside one another are arranged on a transport plate 10 which comprises feet 11 on its underside 10*b*, so that, for example, the fork of a forklift can be introduced beneath transport plate 10. On upper side 10*a*, transport plate 10 comprises recesses 12 into which column tips 5 of a percolation block element 1 can be introduced. A distance D4 arises between underside 2*b* of base wall 2 and upper side 10*a* of transport plate 10, where generally D4 is equal to D1 and is equal to D2. The arrangement shown in FIG. 8 of a plurality of percolation block elements 1 stacked inside one another being arranged on a transport plate 10 can be referred to as a transport unit.

Figure 9:
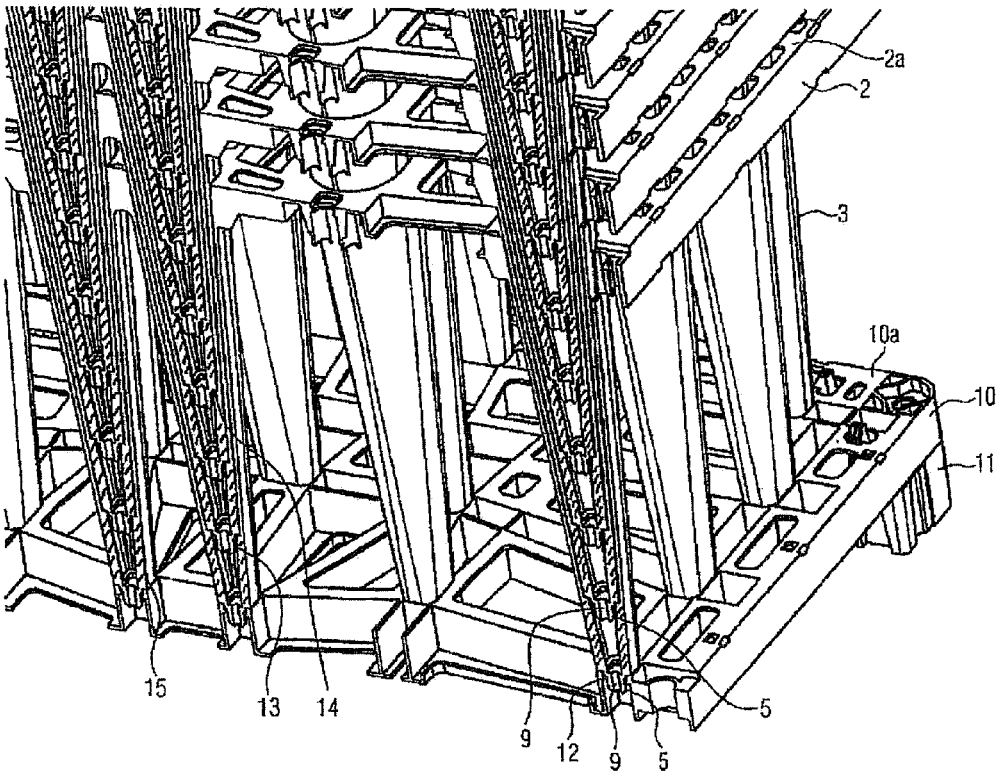
FIG. 9 shows a sectional view of FIG. 8 along line II-II of the columns of the percolation block elements being stacked inside one another.

FIG. 9 shows a sectional view of percolation block elements 1 stacked inside one another along line II-II in FIG. 8 and there in particular columns 3 of percolation block elements 1 that are stacked inside one another. A column tip 5 has a smaller cross-section than column 3, so that a step 13 is formed on the underside of column 3 which in the state when two percolation block elements 1 are stacked inside one another can in the interior of hollow column 3 be introduced in a positive-fit manner into a projection 14. Outer side 15 of a column is generally formed to be smooth.

Figure 10:
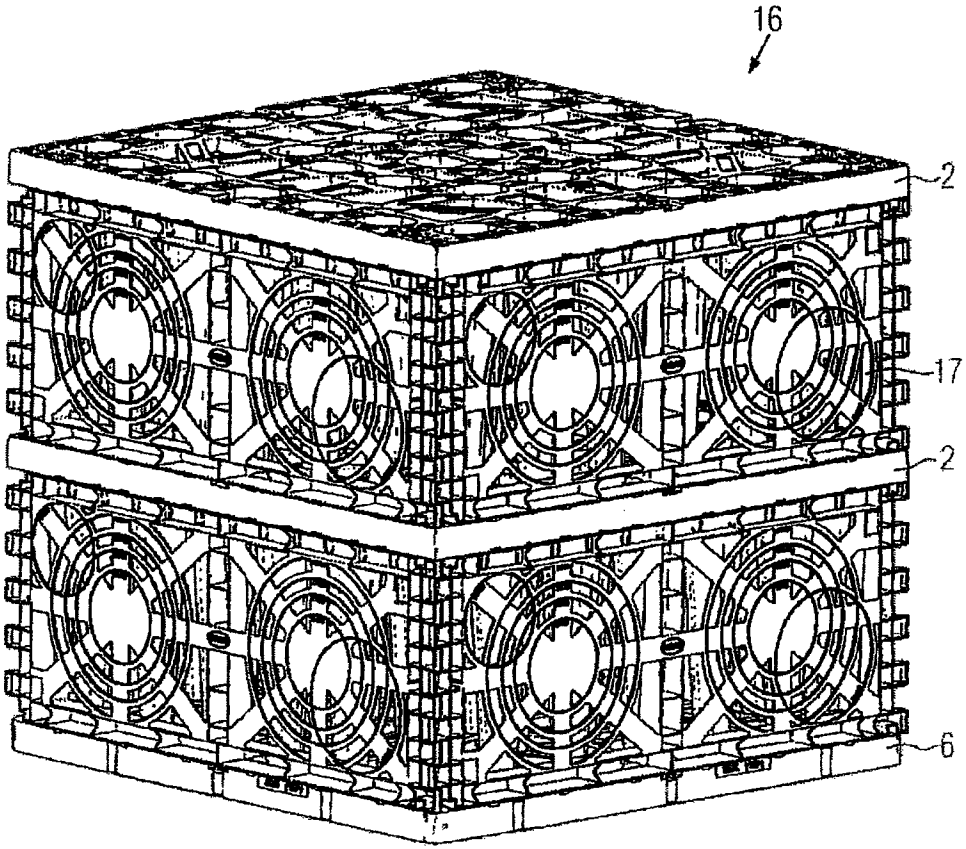
FIG. 10 shows the assembled elements from FIG. 4 with side walls.

FIG. 10 shows the assembled elements of FIG. 4 which result in a percolation block 16 with sidewalls 17. Side walls 17 provide an end of upper and lower percolation block element 1 toward the sides at which no further percolation block elements are arranged. The side walls each have a mesh structure so that the passage of water through side walls 17 is enabled.

Figure 11:
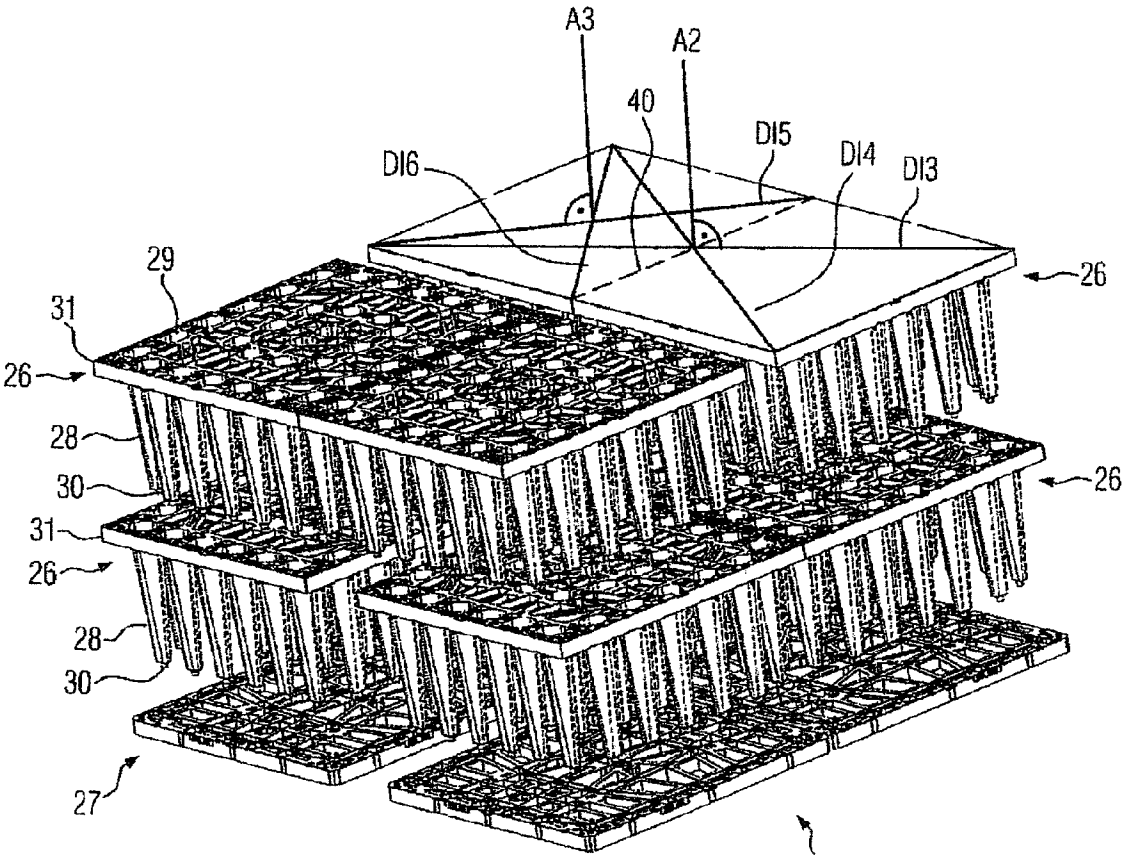
FIG. 11 shows an oblique view of four percolation block elements with a rectangular base area and two rectangular base plates.

FIG. 11 shows an oblique view of four percolation block elements 26 with a rectangular base area and two rectangular base plates 27. A percolation block element 26 with a base wall 31 having a rectangular base consists of two identical percolation block elements 1 each with a base wall 1 having a square base area—as described, for example, in FIG. 1—which are aligned adjacent in the same direction. In the embodiment shown, the two identical percolation block elements 1 have been manufactured from a plastic molding each having a square base area for producing base wall 31 with the rectangular base area. A rectangular base plate 27 consists of two identical base plates 6 each having a square area—as described, for example, in FIG. 1, where the two square base plates 6 in the illustration were for producing the rectangular base plate 27 manufactured from a plastic molding.

Columns 28 of percolation block element 26 with a base wall 31 having a rectangular base area are designed and arranged such that, with two identical percolation block elements 26 that are aligned in the same direction, first columns 28 of first percolation block element 26 can be introduced into second columns 28 of second percolation block element 26 and a stack of two identical percolation block elements 26 that are aligned in the same direction can be formed. Base wall 31 comprises column tip receptacles 29 which are configured to receive column tips 30.

A percolation block element 26 has an axial symmetry of 180° when rotated about an axis of rotational symmetry A2 of the rectangular base area, where the axis of rotational symmetry A2 passes through the intersection of the two diagonals DI3, DI4 of the rectangular base area and extends perpendicular to the rectangular base area of base wall 31.

For better illustration of the profile of the axis of rotational symmetry A2, the two diagonals DI3, DI4 of the rectangular base area, the rotational axis A3 and the two 45°-diagonal DI5, DI6 of the square base area, the rib structure of base wall 31 was not shown in a percolation block element 26 with a rectangular base area. The two identical percolation block elements each with a base wall having a square base area, of which percolation block element 26 with base wall 31 having a rectangular base consists, are indicated by dotted line 40.

To align the four percolation block elements 26 such that they can be assembled for operation, two identical percolation block elements 26 having a rectangular base area are arranged rotated by 90° relative to one another about a rotational axis A3 that is perpendicular to the square base area, so that some column tips 30 of first percolation block element 26 can be introduced into some column tip receptacles 29 of second percolation block element 26 and an operating distance can be formed between the first and the second percolation block element 26. Rotational axis A3 also passes through the intersection of the two 45°-diagonals DI5, DI6 of base wall 2 having the square base area.

Figure 12:
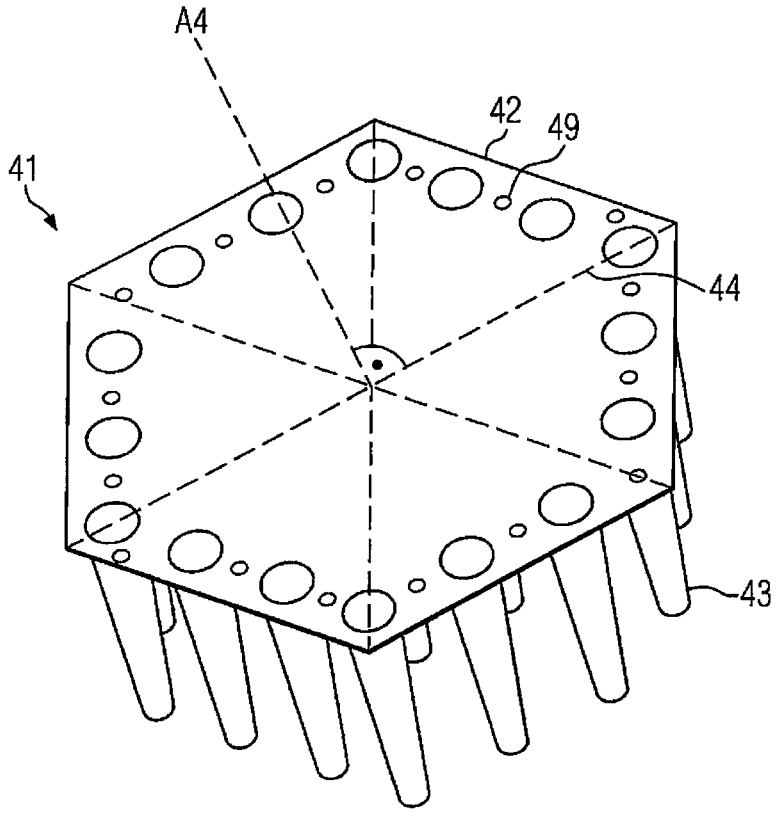
FIG. 12 shows an oblique view of a percolation block element with a hexagonal base area.

FIG. 12 shows an oblique view of a schematically illustrated percolation block element 41 with a base wall 42 having a hexagonal base area to which hollow columns 43 are connected. Column tip receptacles 49 are arranged in base wall 41 between and adjacent to columns 43 and are adapted to receive the column tips of columns 43. In the embodiment shown, axis of rotational symmetry A4 and rotational axis A4 are equal; they extend perpendicular to the base area of base wall 42 and pass through the intersection of the triangular lines 44 of the hexagon illustrated in dashed lines. Percolation block element 41 has an axial symmetry of 180° when rotated about axis of rotational symmetry A4.

Figure 13:
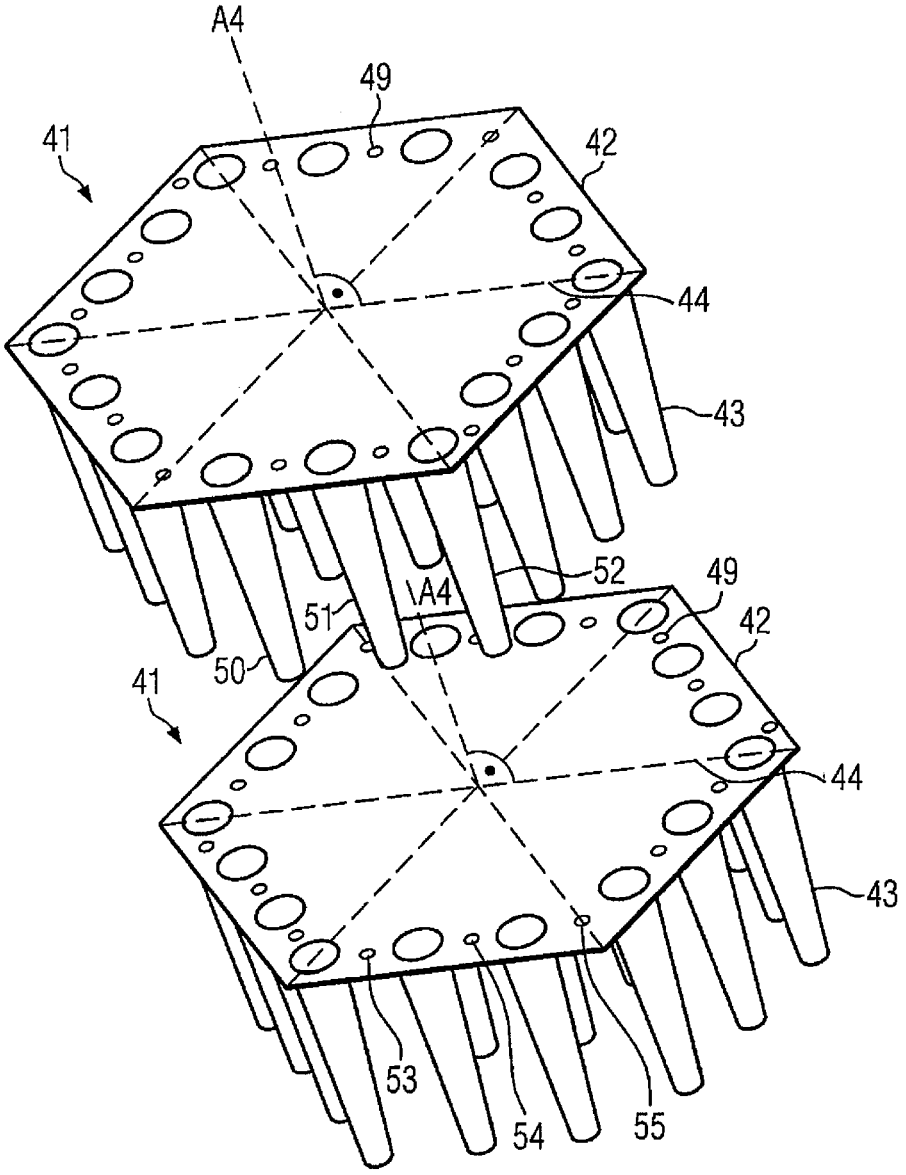
FIG. 13 shows an oblique view of two percolation block elements each with a hexagonal base area.

FIG. 13 shows an oblique view of two percolation block elements 41 each with a hexagonal base area—as described in FIG. 12—where the two percolation block elements 41 are arranged rotated by 60° relative to one another about rotational axis A4, so that column tip receptacles 49 of upper percolation block element 41 can be introduced into column tip receptacles 49 of lower percolation block elements 41, whereby an operating distance can be formed between the underside of upper base wall 42 and the upper side of lower base wall 42. For example, the column tip of column 50 of upper percolation block element 41 can be introduced into column tip receptacle 53 of lower percolation block element 41; the same applies for the column tip of column 51 and column tip receptacle 54 as well as for the column tip of column 52 and column tip receptacle 55.

Figure 14:
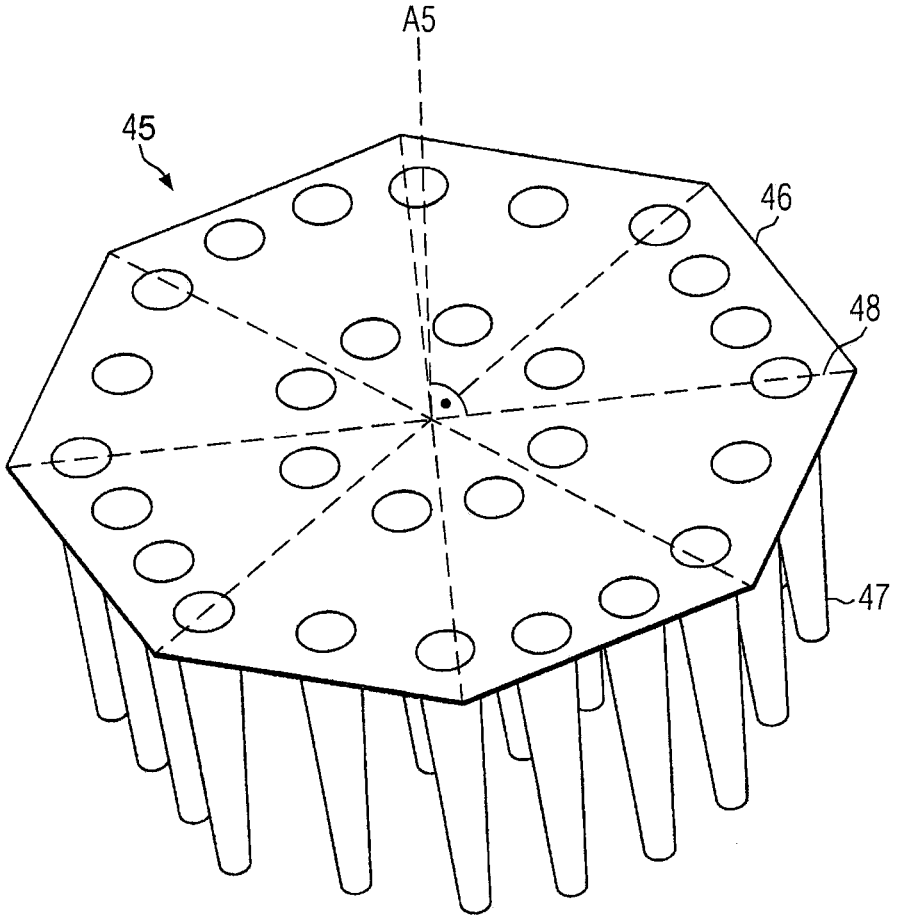
FIG. 14 shows an oblique view of a percolation block element with an octagonal base area.

FIG. 14 shows an oblique view of a schematically illustrated percolation block element 45 with a base wall 46 having an octagonal base area. Connected to the octagonal base area is a plurality of hollow columns 47, where the column tip receptacles disposed in base wall 46 between and adjacent to columns 47 are not shown. In the embodiment shown, axis of rotational symmetry A5 and rotational axis A5 are equal; they extend perpendicular to the base area of base wall 46 and pass through the intersection of the triangular lines 48 of the octagon illustrated in dashed lines. Percolation block element 45 has an axial symmetry of 180° when rotated about axis of rotational symmetry A5.

What is claimed is:

1. A first and second identical percolation block element each comprising a base wall having a square base area with which a plurality of hollow columns is connected, where said columns are configured and arranged such that, with said first and second identical percolation block elements that are aligned in the same direction, said columns of said first percolation block element, so called first columns of said first percolation block element can be introduced into said columns of said second percolation block element, so called second columns, of said second percolation block element, and a stack of said first and second identical percolation block elements that are aligned in the same direction can be formed, and where said base wall comprises column tip receptacles which are adapted to receive column tips, each of said first and second identical percolation block elements having an axial symmetry of 180° when rotated about an axis of rotational symmetry which extends perpendicular to said base area of said base wall, where said column tip receptacles and said columns are further configured and arranged such that, with said first and second identical percolation block elements arranged rotated by 90° relative to one another about a rotational axis that is perpendicular to said base area of said base wall, said column tips of said first percolation block element can be introduced into said column tip receptacles of said second percolation block element, and an operating distance can be formed between a first underside of the base wall of said first identical percolation block and an upper side of the base wall of said second identical percolation block;

wherein said columns and said column tip receptacles are arranged such that said columns and said column tip receptacles are each arranged in mirror symmetry with respect to both center lines of said base wall and are each not in mirror symmetry with respect to both 45° diagonals of said base wall, where, when mirroring at the two 45° diagonals of said base wall, one column tip receptacle of the column tip receptacles comes to rest at a position of one column of the columns and one column of the columns at the position of one column tip receptacle of the column tip receptacles, respectively.

2. The first and second identical percolation block element according to claim 1, where said columns are formed to be substantially conical.

3. The first and second identical percolation block element according to claim 2, where said columns each comprise at least one opening.

4. The first and second identical percolation block element according to claim 1, where said base wall comprises a rib structure.

5. The first and second identical percolation block element according to claim 1, where column tips have a smaller cross-section than said columns, so that a step is respectively formed on an underside of each of said columns.

6. The first and second identical percolation block element according to claim 5, where the inner sides of said columns each comprise a projection that is configured and arranged such that, with the first and second identical percolation block elements that are aligned in the same direction, said step can be introduced in a positive-fit manner into said projection.

7. The first and second identical percolation block element according to claim 1, where each of said first and second identical percolation block element is formed from at least one plastic molding.

8. The first and second identical percolation block element according to claim 1, where said columns are integrally connected to said base wall.

9. The first and second identical percolation block element according to claim 1, where said columns are detachably connected to said base wall.

10. The first and second identical percolation block element according to claim 1, where a first line profile of a wall of a first column of the base wall of the first identical percolation block element, when viewed along a virtual vertical plane, starting out from a first location, at which said first column and a first column tip receptacle of the base wall of the first identical percolation block element directly adjoin, to said upper side of the base wall of the second identical percolation block element, where a first column tip of said first column is introduced into a second column tip receptacle of the base wall of the second identical percolation block element, and from there transitioning to a second line profile of a wall of a second column of the base wall of the second identical percolation block element, starting out from a second location, at which said second column and said second column tip receptacle of the base wall of the first identical percolation block element directly adjoin, merge into each other, where said first and second line profiles are approximately in flush alignment.

11. The first and second identical percolation block element according to claim 1, where, with said first and second identical percolation block elements each arranged rotated by 90° relative to one another about the rotational axis, a symmetric application of load is enabled because the force exerted by one of the first columns of said first percolation block element is evenly transferred to two columns of said second percolation block element because said column tip receptacle for said column of said first percolation block element is disposed on a surface of said base wall of said second percolation block element in a region between two of the second columns of said second percolation block element.

12. The first and second identical percolation block according to claim 1 and further comprising a base plate with receptacles which are adapted to receive column tips.

13. The first and second identical percolation block according to claim 12 where said base plate is formed from at least one plastic molding.

14. The first and second identical percolation block according to claim 12, further comprising at least one side wall.

15. The first and second identical percolation block according to claim 12, where a position of said receptacles of said base plate corresponds to a position of said column tip receptacles of said base wall.

16. A transport unit wherein a plurality of identical percolation block elements that are aligned in the same direction according to claim 1, in which said columns are introduced into one another, and a transport plate or a base plate, on which said plurality of identical percolation block elements that are aligned in the same direction are arranged, where said transport plate or said base plate on the underside of said transport plate or said base plate comprise feet.

17. A percolation block for use in surface water storage or drainage systems comprising:

a square base plate having an upper side and a lower side with base walls there between, said square base plate divided by a center line perpendicular to the base walls and a diagonal line bisecting an intersection of two base walls;

a plurality of hollow columns projecting perpendicularly from the lower side of said base plate, said plurality of hollow columns having a first arrangement that is symmetrical about the center line and not symmetrical about the diagonal line;

a column tip formed on a distal end of each of said plurality of hollow columns; and a plurality of tip receptacles formed on the upper side of said base plate and shaped to mate with a respective one of said column tips, said plurality of tip receptacles having a second arrangement that is symmetrical about the center line and not symmetrical about the diagonal line; and wherein the second arrangement of said plurality of tip receptacles is such that when rotated 90° degrees relative to the first arrangement of said plurality of hollow columns, said column tip formed on a distal end of each of said plurality of columns aligns with a respective one of said plurality of tip receptacles, whereby when two identical percolation blocks are placed over each other so as to have a common centerline said plurality of hollow columns align permitting nesting of the two identical percolation blocks and when the common centerline of one of the two identical percolation blocks is rotated ninety degrees the column tip formed on each of said plurality of hollow columns mate with a respective one of said plurality of tip receptacles permitting stacking with said plurality of hollow columns of one of the two identical percolation blocks positioned between a pair of said plurality of hollow columns of another one of the two identical percolation blocks so as to distribute a load between the pair of said plurality of hollow columns.

18. A percolation block element comprising:

a base wall having a square base and comprising column tip receptacles;

a plurality of hollow columns connected to said square base, said plurality of hollow columns adapted to fit within said column tip receptacles;

wherein said percolation block element has an axial symmetry of 180° when rotated about an axis of rotational symmetry which extends perpendicular from said base wall, and wherein said plurality of hollow columns and said column tip receptacles are arranged in mirror symmetry with respect to orthogonal center lines of said base wall and said plurality of hollow columns and said column tip receptacles are not in mirror symmetry with respect to 45° orthogonal diagonals of said base wall, and when mirroring the 45° orthogonal diagonals each of the column tip receptacles is positioned at one of said plurality of hollow columns, whereby when two percolation block elements are aligned in the same direction the two percolation block elements are capable of nesting and when the two percolation block elements are rotated 90° relative to each other on the axis of rotational symmetry each of the column tip receptacles is positioned between two of said plurality of hollow columns and an operating distance is formed between an underside of one of the two percolation block elements and an upper side of another one of the two percolation block elements.

* * * * *